United States Patent [19]

Travis

[11] Patent Number: 4,928,644

[45] Date of Patent: May 29, 1990

[54] LUBRICATION CONTROL

[76] Inventor: Gilbert E. Travis, 5287 S. Cleveland Massillon Rd., Norton, Ohio 44203

[21] Appl. No.: 387,358

[22] Filed: Jul. 30, 1989

[51] Int. Cl.[5] ..... F01L 3/08

[52] U.S. Cl. ..... 123/188 P; 277/9.5; 277/33; 123/90.37

[58] Field of Search ..... 123/188 P, 90.37; 277/9.5, 33

[56] References Cited

U.S. PATENT DOCUMENTS

| | | | |
|---|---|---|---|
| 2,207,400 | 7/1940 | Gass | 123/188 P |
| 2,821,973 | 2/1958 | Guhman | 123/188 P |
| 2,860,615 | 11/1958 | Mayes | 123/90.37 |
| 3,326,562 | 6/1967 | Deuring | 123/188 P |
| 3,333,578 | 8/1967 | Müller | 123/188 P |
| 3,336,913 | 8/1967 | McCormick | 123/188 P |
| 3,369,819 | 2/1968 | Soo | 277/178 |
| 3,372,941 | 3/1968 | Liebig | 277/178 |
| 3,403,918 | 10/1968 | Liebig | 277/152 |
| 3,490,428 | 1/1970 | Updike et al. | 123/188 P |
| 3,605,706 | 9/1971 | Bush | 123/90.37 |
| 4,198,062 | 4/1980 | Grzesiak | 123/188 P |
| 4,317,436 | 3/1982 | Barnhart et al. | 123/188 P |
| 4,325,558 | 4/1982 | Poggio | 277/189 |
| 4,531,483 | 7/1985 | Vossieck et al. | 123/188 P |
| 4,695,061 | 9/1987 | Meisner et al. | 277/27 |
| 4,730,583 | 3/1988 | Stritzke | 123/188 P |
| 4,763,618 | 8/1988 | Stritzke | 123/188 P |
| 4,773,363 | 9/1988 | Stritzke | 123/188 P |
| 4,826,180 | 5/1989 | Deuring | 123/188 P |

*Primary Examiner*—E. Rollins Cross

*Attorney, Agent, or Firm*—Frederick K. Lacher

[57] ABSTRACT

A three-piece lubrication control for a valve stem of an internal combustion engine comprises removably engaged plastic ring and sleeve members, and an elastomeric grommet positively held in the ring member.

7 Claims, 4 Drawing Sheets

LUBRICATION CONTROL

BACKGROUND OF THE INVENTION

Lubrication controls for valve stems of modern internal combustion engines, which operate in hot, oil-saturated environments, are required to allow only limited lubrication to pass along the stems as they reciprocate thousands of times per minute in their guides. The control materials in movable contact with the valve stems must be resistant to fuels, oils and gases, and heat sometimes above 300° F. (149° C.), as well as aging and wear. This dictates the use of relatively sophisticated and expensive elastomers, such as polyacrilates, silicone rubbers, fluoroelastomers and the like.

PRIOR ART

Basically, two general types of controls exist, both of which are known in the art as "seals" although neither one entirely precludes lubricants from passing. One type is the "umbrella" seal, which clings to the valve stem and reciprocates with it, shielding the passage to the guide. The other type is called a "positive" seal and remains seated on the valve guide while the valve travels through it.

Examples of the umbrella seal may be seen as follows: The 1969 U.S. Pat. No. 3,403,718 to Liebig, denotes at 36 a one-piece nylon cup held in place on a valve stem 16 by a split wire ring 46. Also, in the 1971 U.S. Pat. No. 3,605,706 to Bush, is shown a one-piece umbrella of glass-filled nylon. In the 1988 U.S. Pat. No. 4,763,618 to Stritzke an umbrella 44 of filled nylon loosely containing an O-ring is shown. In an earlier 1965 U.S. Pat. No. 3,372,941, to Liebig there is disclosed a molded plastic umbrella 36 with an elastomeric insert 50. In the 1988 U.S. Pat. No. 4,730,583 to Stritzke there is disclosed an O-ring 62, contained in a space between a retainer ring 58 and a deflector 44.

Positive seal examples may be seen as follows: McCormick U.S. Pat. No. 3,336,913 (1967) has a unitary seal 18 which is heat-shrunk onto the guide 32. In Poggio U.S. Pat. No. 4,325,558 (1982), the one-piece seal 14 is clamped onto the guide 13 by cap 21. In Meisner et al U.S. Pat. No. 4,695,061 (1987), a monolithic seal 15 is seated in undercuts in the guide.

It is noted that none of the prior art discloses or suggests the novel three-piece lubrication control of the present invention, where a grommet is positively and complementarily held in an external ring, which in turn is snapped into a sleeve member.

The instant invention is directed to providing a lubrication seal usable for both the "positve" and the "umbrella" types of seals; the three-part seal consequently comprises a relatively rigid outer annular ring, a relatively rigid skirted sleeve removably engaged with the ring and a cylindrically bored, resilient grommet locked complementarily into the ring.

In accordance with one aspect of the invention there is provided a lubricating control for a valve stem reciprocating in a valve guide, comprising:

a first relatively stiff ring member, a second, relatively stiff, annular sleeve member separably engaged with the ring member; and a resilient grommet held within the ring member and encircling the valve stem.

The three-piece construction affords many choices with a relatively small inventory such as the ability to use grommet families having a wide range of bore diameters, with the same ring; the use of different size rings to accommodate different grommet families; and the use of sleeves having different diameters and configurations with the same ring.

Where the device is used as a positive seal, the conformation of the skirt portion of the sleeve is such that a nonslip press-fit exists with the valve guide. The inventive control is thus inexpensive to manufacture and inventory, and easily assembled.

DESCRIPTION OF THE INVENTION

Figure 1:
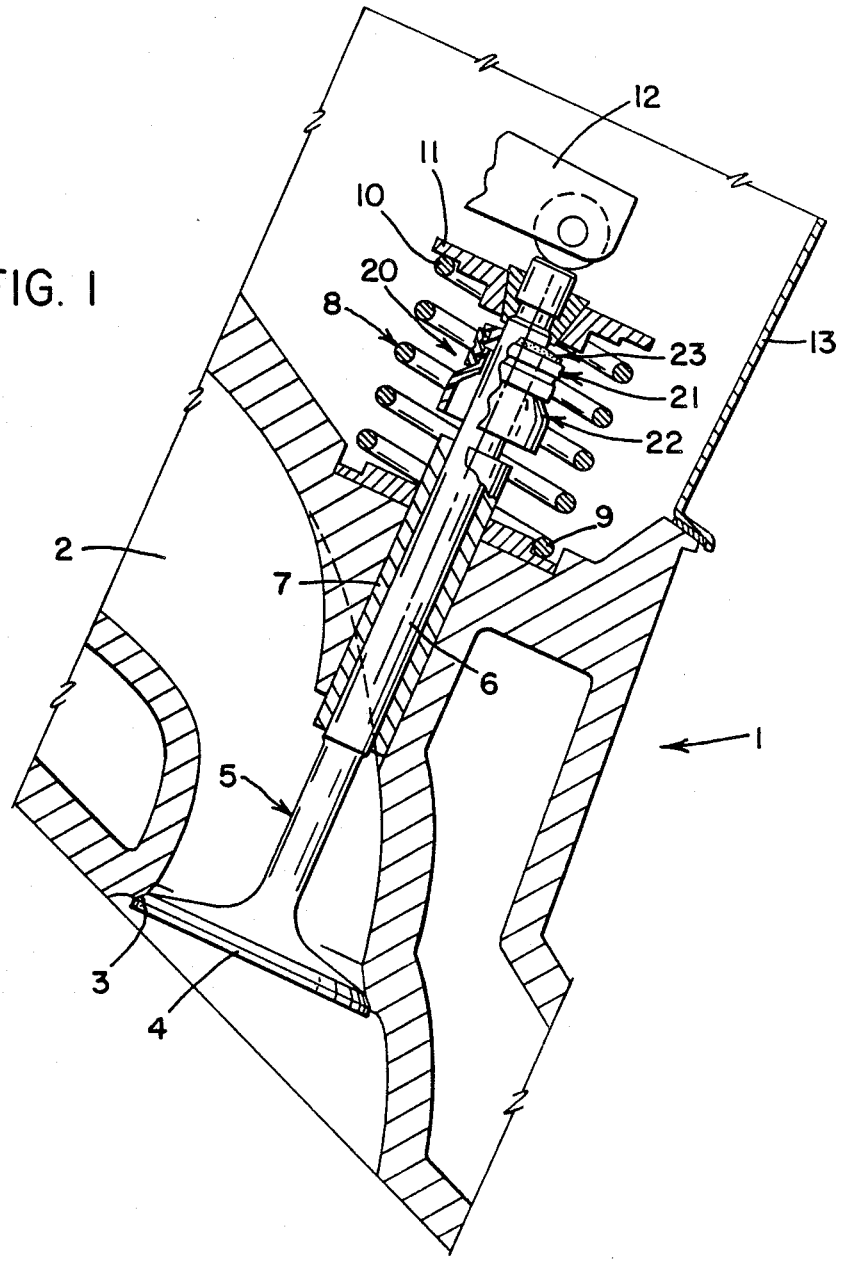
FIG. 1 is a partial cross section of a portion of an internal combustion engine, showing a three-piece lubrication control of the invention in place on the valve stem.

Referring now to the drawings, there is shown at 1 a cylinder head of an internal combustion engine having a passage 2 terminating in a seat 3 for a head 4 of a valve 5, whose stem 6 reciprocates in a valve guide 7. A coil spring 8 surrounds the valve stem 6 and rests with a lower end 9 on a collar of the cylinder head 1, while an upper end 10 abuts a spring retainer 11 affixed to the valve stem 6. A rocker arm 12, located within a rocker arm cover 13, engages the upper end of the valve stem 6, in order to reciprocate the valve 5, in a manner well known within the art.

Figure 3:
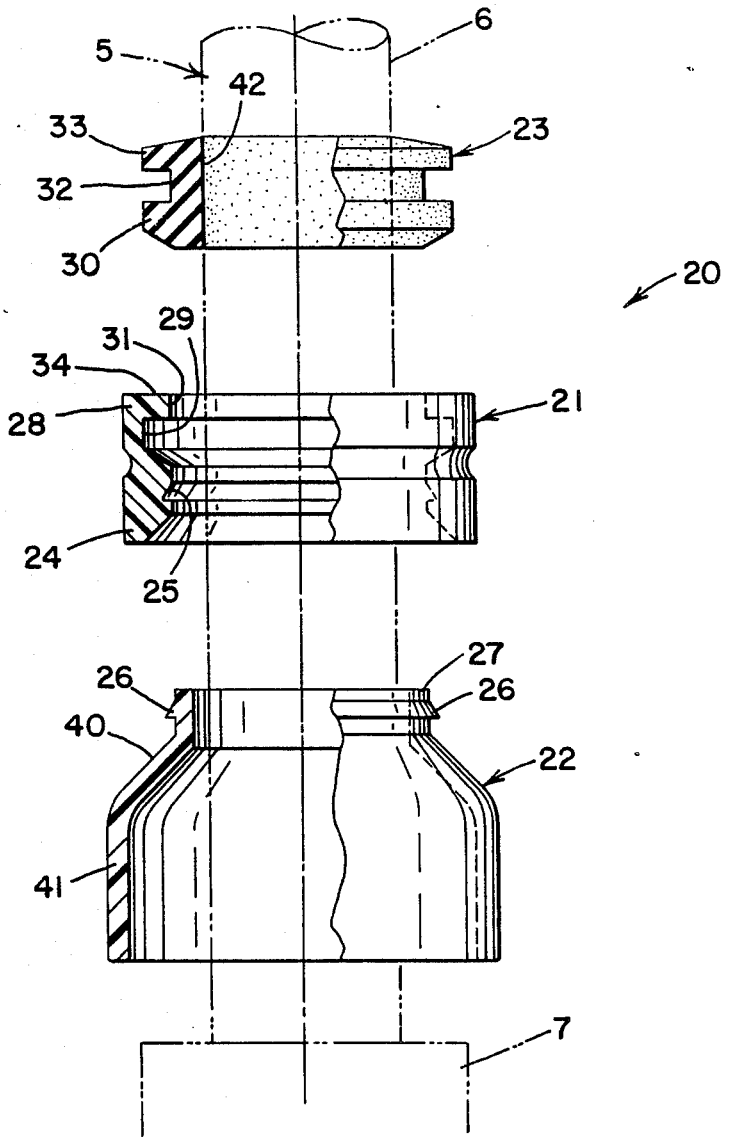
FIG. 3 is an exploded view, in section, showing the embodiment of FIG. 1.
Figure 4:
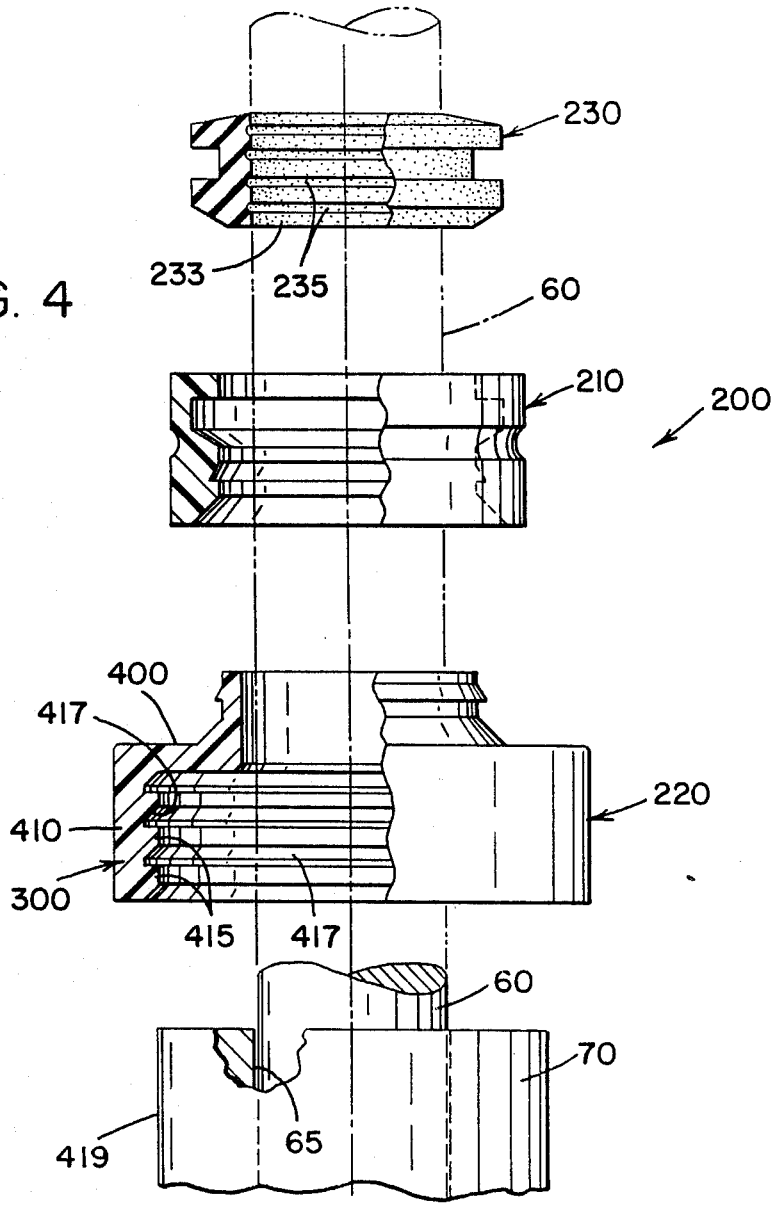
FIG. 4 is an exploded view, in section, showing the embodiment of FIG. 2.

Located on the valve stem 6 in accordance with one major embodiment is an inventive controller 20, shown in greater detail in FIG. 3, and comprising three complementary parts: an external ring 21, an annular sleeve 22 removably engageable with the ring 21, and an annular, flexible grommet 23 positively held within the ring 21. The ring 21 and sleeve 22 are preferably manufactured of a relatively stiff plastic material such as, for example glass-filled nylon which has exhibited outstanding performance under conditions of the high temperature and pressure encountered in use.

An axially lower end 24 of the ring 21 has an interior undercut 25 which is adapted to snap onto a lower lip 26 of an axially upper end 27 of the sleeve 22, thus maintaining the ring and the sleeve in engagement. An upper end 28 of the ring 21 is provided with a shaped recess 29 adapted to receive positively an axially lower end 30 of the grommet 23. When the grommet 23 is in place with the lower end 30 engaged with the recess 29, a radially, inwardly extending lip 31 of the ring 21 engages a groove 32 on the grommet 23, while an upper lip 33 of the grommet overlies a top face 34 of the ring 21.

At the end opposite the upper end 27, the sleeve 22 merges into radially and axially extending shoulder 40, which, in turn, merges an and axial skirt or umbrella skirt 41 having an internal diameter greater than the outside diameter of the valve guide 7.

The grommet 23, being resilient, may of course be deformed slightly in order to be fitted into the ring 21, where its diameter causes it to be positively held. An internal diameter 42 of the grommet 23 is chosen so that the radially inner face of the grommet grasps the stem 6 of the valve 5 and moves with it. The interengagement of the grommet 23 with the ring 21, and the ring with the sleeve 22 thus causes the entire three-part assembly to reciprocate with the stem 6.

The grommet 23 is preferably made of a resilient elastomeric compound such as polyacrilate, silicone rubber, fluoroelastomer or the like, all of which elastomers are recognized as being resistant to chemical reactions, temperature extremes, wear and aging. They are, however, relatively expensive, and presently available seals, if they are to be stocked in all required diameters, represent a very large and costly inventory. Rather than stocking such a range, it is possible, with this invention, to stock a selection of grommets 23 of different internal diameters 42. For example, one "family" of grommets 23 might have internal diameters 42 of 5/16, 11/32 and ⅜ inches (0.79375, 0.87312 and 0.925 cm), all of which would have the same external diameter so that each of them can be accommodated into one particular size ring 21. A next different "family" of grommets 23, either larger or smaller, or perhaps in metric sizes, would then be accommodated in another particular size ring of a commensurately different internal diameter. Each ring 21 would still be removably engageable with the same sleeve 22.

Figure 2:
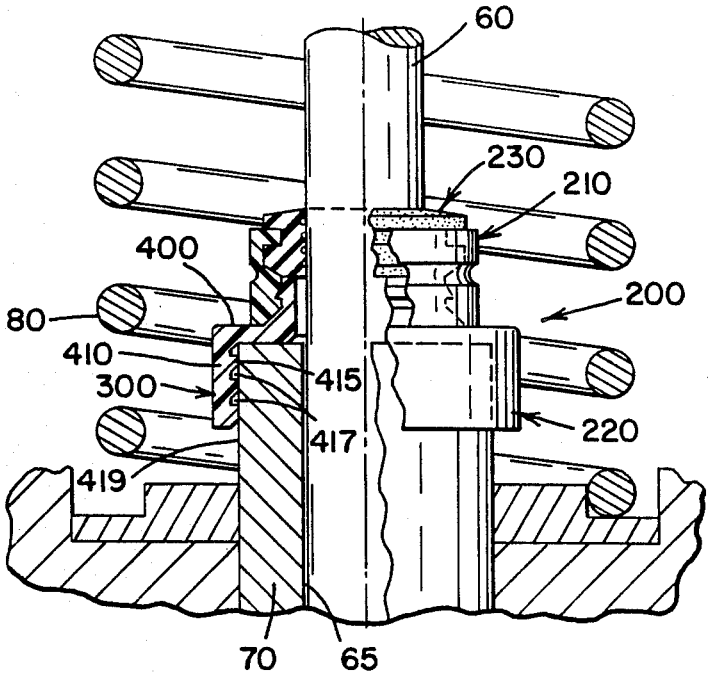
FIG. 2 is a fragmentary view, partially in section, showing the control of the invention in place on a valve guide.

Turning now to the second major embodiment of the invention, FIG. 2 shows a stem 60 of a valve which reciprocates in a guide 70, a small clearance 65 being created by a difference in their diameters to allow lubrication to pass. A compression spring 80 and a well-known rocker arm (not shown) act on the valve.

The lubrication control, here a so-called "positive seal" 200, again comprises three parts, a relatively stiff annular sleeve 220 engaged with a relatively stiff ring 210, and a resilient grommet 230 carried by the ring. As will be noted, an axially lower end 300 of sleeve 220 fits sealingly upon, and fixedly engages, the outer surface of the valve guide 70. To this end, the lower end 300 extends generally into a radial shoulder 400, and then into a skirt 410, whose inner surface is provided with a series of concentric or helical protrusions 415, separated by spaces 417, for closely gripping an outer surface 419 of the guide 70. In order for the grommet 230 to wipe the stem 60 as it reciprocates through the guide 70, an interior surface 233 of the grommet is provided with metering grooves 235, either concentric or helical, which act to "pump" a required, metered amount of lubrication along the stem 60 during each cycle.

While the same interchangeability of the families of grommets 230, with different size rings 210 exists as in the above embodiment, it will be seen that, additionally, the diameter of the sleeve 300 may be selected according to the guide 70 to be fitted, while the ring 210 and the sleeve 220 may remain the same; or indeed, they may be changed also.

While preferred embodiments of the invention have been disclosed and claimed herein, variations may occur to those skilled in the art without, thereby, departing from the scope of the claimed invention.

What I claim is:

1. A lubricating control for a valve stem reciprocating in a valve guide, comprising:

a first relatively stiff ring member, a second, relatively stiff, annular sleeve member separably engaged with said ring member; and a resilient grommet held within said ring member and encircling said valve stem.

2. A lubricating control as in claim 1, wherein an axially upper end of said sleeve engages an axially lower end of said ring, and said grommet is held within an axially upper end of said ring.

3. A lubricating control as in claim 1, wherein said sleeve has an axially extending, cylindrical skirt adapted to engage said valve guide tightly.

4. A lubricating control as in claim 1, wherein a radially inner face of said grommet is grooved circumferentially.

5. A lubricating control as in claim 1, wherein said sleeve has an axially extending umbrella skirt, having an internal diameter greater than the outside diameter of the valve guide.

6. A lubricating control as in claim 1, wherein said grommet has a radially inner face adapted to grasp said valve stem and moves with it.

7. A lubricating control as in claim 1, wherein said grommet wipes said valve stem during reciprocation of said valve stem.

* * * * *